United States Patent [19]

Dorman et al.

[11] 4,436,184

[45] Mar. 13, 1984

[54] ELEVATOR SYSTEM

[75] Inventors: John G. Dorman, Randolph; Anthony M. Balbo, Millburn, both of N.J.; Charles E. Randall, Boiling Springs; Robert A. Sette, Gettysburg, both of Pa.

[73] Assignee: Westinghouse Electric Corp., Pittsburgh, Pa.

[21] Appl. No.: 375,249

[22] Filed: May 5, 1982

[51] Int. Cl.[3] ..... B66B 13/16

[52] U.S. Cl. ..... 187/29 R; 187/57

[58] Field of Search ..... 187/29, 33, 49, 56, 187/57, 61

[56] References Cited

U.S. PATENT DOCUMENTS

| | | | |
|---|---|---|---|
| 1,822,152 | 9/1931 | Kinnard et al. | 187/29 |
| 3,721,319 | 3/1973 | Hall et al. | 187/57 X |
| 3,878,919 | 4/1975 | Dewhurst | 187/57 X |
| 3,991,858 | 11/1976 | Westerlund | 187/57 X |
| 4,313,525 | 2/1982 | McDonald | 187/57 |
| 4,357,998 | 11/1982 | Gibson et al. | 187/57 X |

FOREIGN PATENT DOCUMENTS

| | | | |
|---|---|---|---|
| 2334844 | 2/1975 | Fed. Rep. of Germany | 187/57 |

*Primary Examiner*—J. V. Truhe
*Assistant Examiner*—W. E. Duncanson, Jr.
*Attorney, Agent, or Firm*—D. R. Lackey

[57] ABSTRACT

An elevator system including an elevator car having an electromechanical door restraint mechanism which prevents the forceable opening of an elevator car door by passengers when the elevator car stops outside a predetermined zone adjacent to a floor level, at least to an extent which would enable passenger exit from the car.

21 Claims, 6 Drawing Figures

ELEVATOR SYSTEM

BACKGROUND OF THE INVENTION

1. Field of the Invention

This invention relates in general to elevator systems, and more specifically to new and improved arrangements for preventing the doors of an elevator car from being forceably opened when the elevator car stops outside a predetermined allowable displacement zone from a floor level.

2. Description of the Prior Art

In certain instances, an elevator car may stop for an unscheduled length of time, displaced from a landing or floor. This may occur due to the failure of the electrical power supplied to the building, or because of an occurrence which triggers an emergency stop of a moving elevator car. While the doors of the elevator car will not automatically open when the car is still outside the landing zone, passengers may attempt to force the doors open, against the frictional retarding force of the door operating mechanism. While the door may be mechanically locked, such as when the car starts a run, and mechanically unlocked at floor level, such as by a cam located at each floor which unlocks and locks the lock mechanism on the car, this presents many problems. If the car is close enough to a landing that egress may be safely made, it would be undesirable to lock the doors and prevent passenger exit. This is especially true during a general power outage, which would unduly delay authorized personnel from attending each elevator car, because of the number of elevator cars which may be so stranded. Also, even when outside the landing zone, a slight opening of the car doors for ventilation purposes is beneficial, as long as the doors do not open to the extent of permitting passenger exit. Still further, there are certain times when mechanical door locks are completely undesirable. For example, firemen use elevator cars to take equipment close to the floor of a fire, with the firemen placing the car in a firemen's mode, using a keyed switch, which allows them to have more complete control over the operation of the car and its doors. A mechanical lock of the car doors outside the landing zone would thus be undesirable. Other instances where mechanical door locks would be undesirable are during a hospital emergency mode, and when the elevator car is operated by maintenance personnel on "hand" control.

Thus, it would be desirable to provide a door lock for an elevator car which provides positive restraint against unauthorized door opening outside the landing or leveling zone, but which has the flexibility of accommodating those instances when locking is undesirable.

SUMMARY OF THE INVENTION

Briefly, the present invention is a new and improved elevator system in which an elevator car includes an electromechanical door lock. The zone adjacent to each floor which defines the zone of door lock deactivation may be established by apparatus which is already an integral part of a conventional elevator system, requiring nothing to be specially installed or maintained in the hatchway. The additional electrical wiring required is minor, and performable in the factory when the car controller and door operator are wired. The mechanical portions of the door lock are also installable on the door operator and door hanger assembly at the factory. The fact that no special hatchway equipment is required, also makes it possible to economically retrofit elevators which are already installed.

The control associated with the electromechanical door lock function provides the desired flexibility, enabling keyed switch override of the locking function by authorized personnel. It also automatically prevents lock deactivation as non-target floors are passed by the elevator car as it proceeds to a target or destination floor.

Power failure will automatically activate the lock. Authorized personnel with an emergency power supply may remotely release the locks; or, an emergency power supply may be automatically connected to the lock controls to continue to provide selective locking, and unlocking, of the car doors, according to the car's position relative to a landing zone.

A manual release mechanism is provided on the lock, which enables the lock to be released by authorized personnel from a location outside the elevator car, such as from a hallway.

The lock arrangement of the invention is such that it may be arranged to allow a predetermined small opening of the car door, for ventilation purposes. Finally, the lock arrangement may also be used to function as a "door release", as it prevents complete closure of an open elevator car door, when electrical power is removed from the door controls.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF THE PREFERRED EMBODIMENTS

Figure 1:
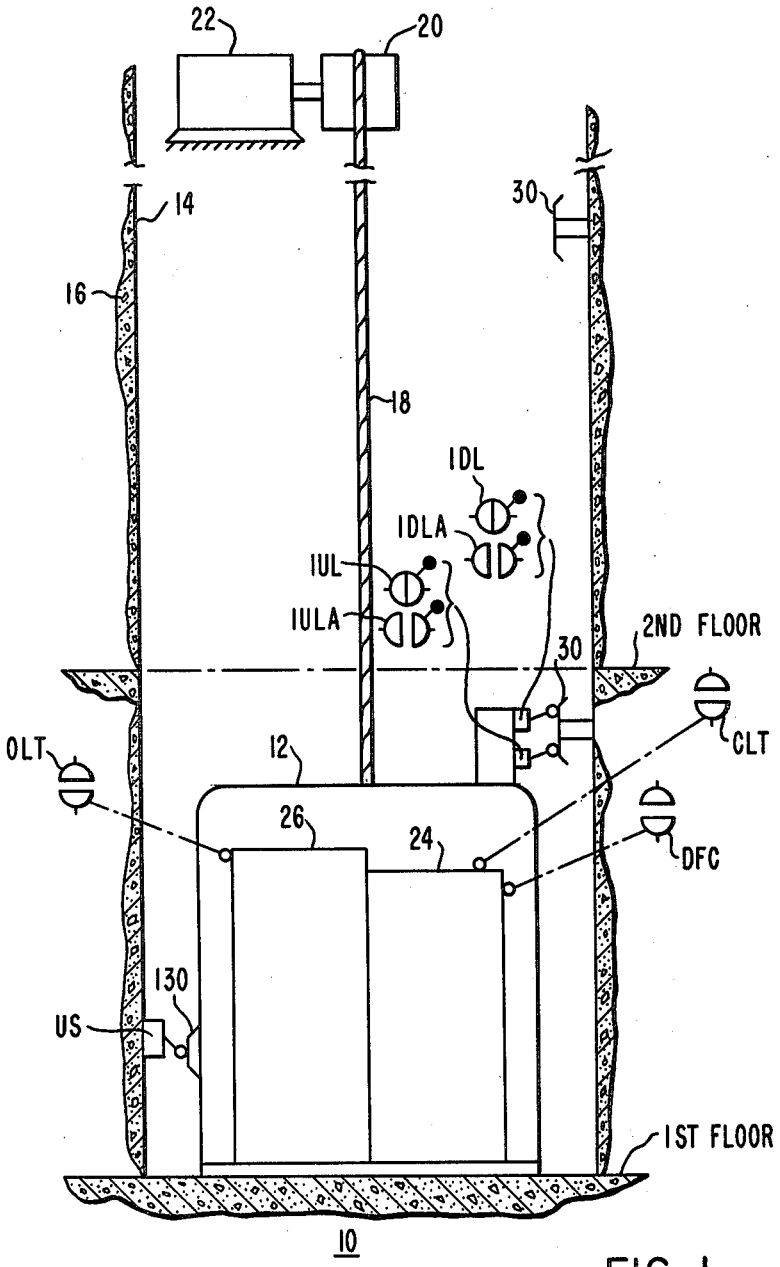
FIG. 1 is an elevational view of an elevator system which may utilize the teachings of the invention.

In order to limit the length and complexity of the present application, only those portions of an elevator system which are necessary in order to understand the present invention will be described. The invention may be implemented by electromechanical relays, solid state logic gates, or microprocessor. For purposes of example, a relay implementation is disclosed. U.S. Pat. Nos. 3,902,572, 4,042,068, and 4,317,506, which are assigned to the same assignee as the present application, disclose relay circuitry for controlling certain of the electrical contacts included in the drawings of the present application, and these patents are hereby incorporated into the present application by reference.

Referring now to the drawings, and to FIG. 1 in particular, there is shown an elevator system 10 which may be modified according to the teachings of the invention. The invention applies to elevator systems having any type of motive means, such as electric traction elevators and hydraulic elevators. For purposes of example, elevator system 10 is illustrated as being of the electric traction type. Elevator system 10 includes an elevator car 12 mounted for guided vertical movement in the hatchway 14 of a structure or building 16 having a plurality of landings or floors to be served by car 12. Only the first and second floors are shown, as the operation of the elevator system is similar for each floor.

Elevator car 12 is supported in hatchway 14 by a plurality of wire ropes 18 which are reeved over a traction sheave 20. Traction sheave 20 is connected to a drive machine 22, which includes either an AC or a DC drive motor and a suitable source of electrical potential.

Elevator car 12 includes an opening 24 to a passenger compartment, and closure means in the form of one or more door panels, such as door panel 26, hereinafter simply referred to as door 26, which is operated to control passenger movement between the car 12 and an adjacent landing. The hatch doors at the landings, which are operated in unison with the car door 26, are not shown.

FIG. 1 illustrates certain limit switches which are actuated by door 26 when it is in certain positions. Car door 26 is illustrated in its fully open position in FIG. 1, and in its fully closed position in FIG. 2. When door 26 is fully open, an n.c. door open limit switch OLT is actuated to its open position. When door 26 starts to close, switch OLT closes, and, about ¼ inch from the fully closed position, an n.o. door close limit switch CLT is actuated to its closed position. When door 26 is fully closed, an n.o. limit switch DFC is actuated to its closed position.

The position of elevator car 12 adjacent to a landing, for purposes of accurately landing the car, and for releveling the car, such as may be necessary due to rope stretch or contraction as the load changes, may be accomplished in many different ways. For example, it may be accomplished by magnetic markers in the hatchway and an inductor relay on the car; by reflectors of electromagnetic radiation, or shields for such radiation, disposed in the hatchway, and an optoelectronic detector on the car; or, by cams disposed in the hatchway and mechanical switches on the car. For purposes of example, the cam/switch arrangement is illustrated in FIG. 1.

More specifically, n.c. switches 1DL and 1UL, carried by the car 12, are both actuated to their open positions by a cam 30 associated with each floor, when the floor of the passenger compartment is level with the hallway floor at which the car is stopped. Normally open switches 1DLA and 1ULA are auxiliary to 1DL and 1UL, respectively. Switches 1DL and 1UL are the normal leveling switches, providing signals over the conventional traveling cable for the car controller. Switches 1DLA and 1ULA provide signals for car mounted control, as will be hereinafter explained. If the car 12 should move downward slightly, switches 1UL and 1ULA will come off of cam 30 and switch 1UL will initiate "up leveling". If the car 12 should move upwardly, switches 1DL and 1DLA will come off of cam 30 and switch 1DL will initiate "down leveling".

Cam 30 defines a landing or leveling zone adjacent to its associated floor, when at least one of the switches 1UL and 1DL is actuated by cam 30, with the zone typically being ±3 or 4 inches, for a total zone length of 6 or 8 inches.

A zone of ±3 or 4 inches from floor level is a reasonable or allowable displacement zone relative to the floor level of an associated landing, which, if the car 12 were to stop in for an unscheduled length of time without opening its doors, the passengers could reasonably be allowed egress by forceably opening the car doors. Thus, the landing cams 30 and leveling switches 1UL and 1DL may conveniently be used to provide signals for locking, and unlocking, the car doors according to car position.

A zone longer than ±3 or 4 inches may be safely used, and a dedicated switch and cams may be used, if desired, to define the allowable zone adjacent to a floor where the car door may be unlocked. Less equipment is involved, and retrofitting is much simpler, when existing elevator functions are used to provide the allowable zone signals, and, accordingly, are used in a preferred embodiment of the invention, as set forth in detail in FIG. 5.

Figure 2:
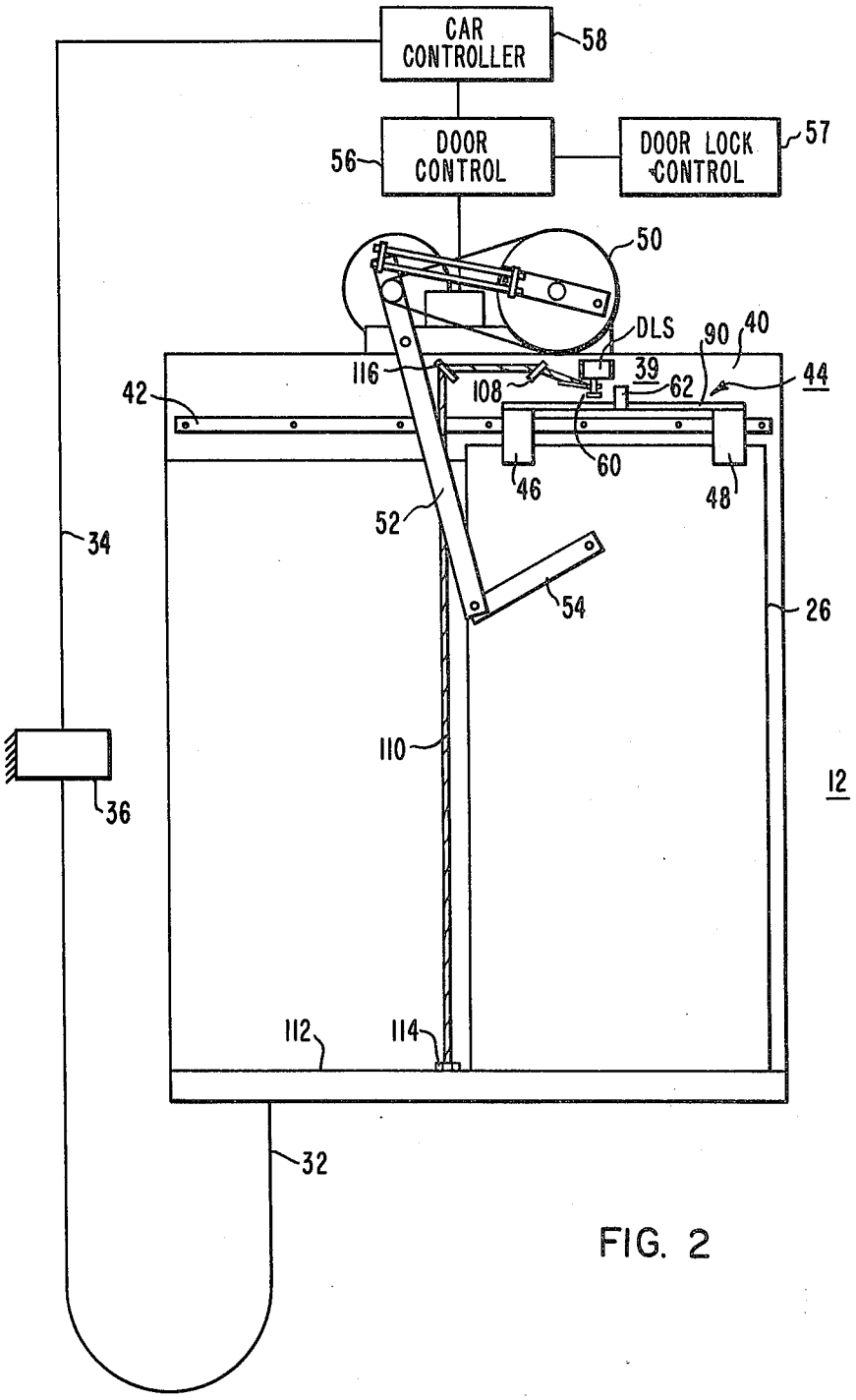
FIG. 2 is an enlarged, more detailed view of the elevator car shown in FIG. 1, having an electromechanical door lock constructed and mounted according to the teachings of the invention.

FIG. 2 is an enlarged view of elevator car 12, illustrating an electromechanical door lock assembly 39 and its associated control 57, applied to car 12 according to the teachings of the invention. Car 12 includes a door header 40 to which a hanger roller guide track 42 is mounted. A hanger assembly 44 is mounted on the top of door 26, which may include first and second spaced smaller hanger plates 46 and 48, to which hanger rollers (not shown) are journaled for rotation.

A door operator 50, mounted on top of car 12, is linked to door 26 via operating levers 52 and 54, with the door control being shown generally at 56, and with the door lock control being shown generally at 57. The door control 56 responds to signals from a floor selector, which is part of a car controller, with the car controller being shown generally at 58. Signals between the car controller 58 and car 12, as well as normal electrical power for car 12, utilize a traveling cable 32, a fixed cable 34, and a junction box 36.

Figure 3:
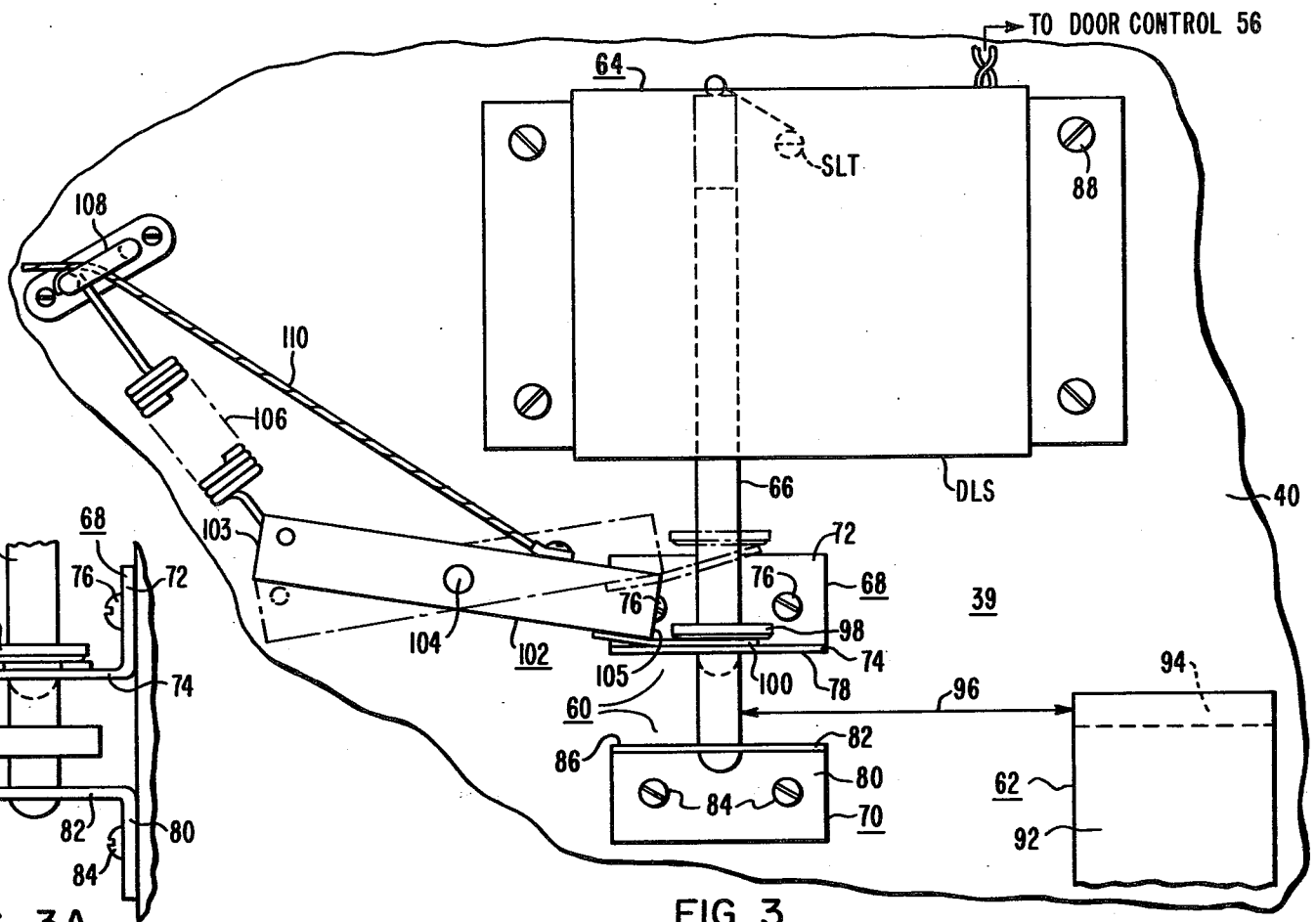
FIG. 3 is an enlarged elevational view of the door lock mechanism shown in FIG. 2.
Figure 3A:
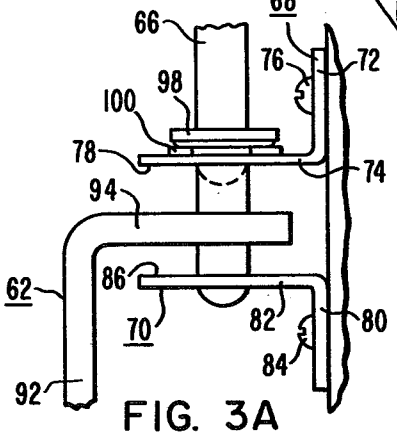
FIG. 3A is a fragmentary, side elevational view of the bracket elements of the door lock mechanism shown in FIG. 3.

The electromechanical door lock assembly 39, which is shown enlarged in FIG. 3, and in a fragmentary side elevational view in FIG. 3A, includes first bracket means 60 fixed to the door header 40, second bracket means 62 fixed to the door 26, such as to the hanger assembly 44, and an electrical solenoid assembly 64 which includes an electrical coil DLS, asn armature or iron core plunger 66, and an n.o. limit switch SLT which is actuated to its closed position when coil DLS is energized and plunger 66 is lifted within coil DLS.

The first bracket means 60 may include a single mounting base and a pair of spaced projections or leg portions, or, as illustrated, it may be formed by first and second L-shaped bracket members 68 and 70. Bracket members 68 and 70 are formed of a strong, non-magnetic material, such as brass. Bracket member 68 has first and second leg portions 72 and 74, respectively, with leg portion 72 functioning as a mounting base which is attached to door header 40, such as via screws 76. Leg portion 74 extends perpendicularly outward from header 40, with its major flat surfaces, such as surface 78, facing downwardly, parallel with the floor of car 12, i.e., horizontally oriented.

In like manner, bracket member 70 has first and second leg portions 80 and 82, respectively, with leg portion 80 functioning as a mounting base which is attached to door header 40, such as via screws 84. Leg portion 82 extends perpendicularly outward from header 40, with its major flat surfaces, such as surface 86, facing upwardly, and horizontally oriented.

Surfaces 78 and 86 of the first bracket means 60 are spaced a predetermined dimension from one another, and their associated leg portions 74 and 82, respectively, have openings therein which are in vertical alignment, for receiving plunger 66. These openings are sized just slightly larger than the diameter of plunger 66, allowing the plunger 66 to move freely up and down without interference with the first bracket means, but close enough to plunger 66 to function as a guide, and also as a support against lateral forces, as will be hereinafter explained.

Solenoid assembly 64 is mounted on header 40, such as via screws 88, and it is located such that plunger 66, when coil DLS is deactivated, will drop by gravity to the solid line position shown in FIGS. 3 and 3A. In this solid line deactivated position, it extends through both of the aligned openings, including the opening in the lower leg portion 82. When the solenoid coil DLS is energized, plunger 66 is lifted into the coil to the broken line position shown in FIGS. 3 and 3A. It is important to note that plunger 66, even in the retracted position, is still within the opening of the upper leg portion 74, and it is thus positively guided at all times.

The second bracket means 62 is mounted to be carried by the door 26 as it moves between its open and closed positions. If the hanger plate is a single plate, the second bracket means may be mounted at the top thereof. If spaced hanger plates 46 and 48 are used, a bar or rod member 90 may be mounted between the plates 46 and 48, and the second bracket means 62 fixed to member 90. The second bracket means 62, which may be formed of steel, since it will not contact plunger 66 when solenoid coil DLS is energized, may be an L-shaped bracket having first and second leg portions 92 and 94, respectively. Leg portion 92 may function as a mounting base, which is suitably fixed to member 90. Bracket means 62 is oriented such that leg portion 94 is at the upper end thereof, with the end of the leg portion extending inwardly toward door header 40. Leg portion 94 is positioned such that when door 26 is operated between its open and closed positions, it will pass freely between surfaces 78 and 86 without interference, and without striking plunger 66, when plunger 66 is lifted to its energized position. When plunger 66 is dropped to its deenergized position, leg portion 94 is dimensioned and positioned such that it will strike plunger 66, forming a positive lock against any further movement of door 26. Thus, when door 26 is closed and plunger 66 is in its deenergized position, door 26 can be moved toward its open position only by a small dimension 96. Dimension 96 is selected such that it will be sufficient to enable a mechanical door lock override feature to be performed, to be hereinafter described, without opening to the extent of allowing passenger exit. This small opening will also aid car ventilation.

The leg portions 74 and 82 of the first bracket means 60 form a strong support structure for plunger 66 against lateral forces which may be applied thereto by the second bracket means 62. It is important to prevent lateral forces which are applied to plunger 66 from being transmitted to a non-magnetic tube (not shown) which surrounds the iron plunger with the coil DLS.

In addition to positively limiting the extent of door opening when solenoid coil DLS is deenergized, it may also be used to provide a door release function when the car is shut down and power removed. To function in this mode, power is removed while the door 26 is open, dropping plunger 66 into its blocking position. Thus, door 26 cannot be fully closed.

Before explaining the electrical override features of the invention, a mechanical override feature, actuatable by authorized personnel from outside the elevator car, will first be explained. A ring member 98 is fixed to an intermediate portion of plunger 66, in a position which enables a lifting finger 100 to just fit between ring member 98 and the upper surface of leg portion 74 when solenoid coil DLS is deenergized. Finger 100 is fastened to an operating level 102 having first and second ends 103 and 105, respectively, with lever 102 being pivotally fixed to header 40 about a pivot axis 104. Finger 100 is fixed adjacent to the second end 105 of lever 102, and lever 102 is biased in a clockwise direction, as viewed in the Figure, by a tension spring 106. One end of spring 106 is linked to the first end 103 of the operating lever 102, and the other of spring 106 is linked to a staple member 108. Member 108 is fixed to header 40. Thus, lever 102 is biased such that finger 100 is pressed downwardly against the upper surface of leg portion 74.

A cable 110 is provided which has one end secured near the second end 105 of lever 102, and it is directed to extend through a pair of guides to the door sill 112, where it is anchored at 114. The staple member 108 may function as the first guide for the cable 110, and a similar staple member 116 may function as the second guide point. The cable 110 extends upwardly from lever 102 through staple member 108, and then laterally away from opening 24 of the car 12 to the guide 116. Guide 116 is located such that when cable 110 is directed vertically downward therefrom to anchor 114, it will clear the door 26 as it is operated between its open and closed positions, and also be out of visual sight back of the return jam when the door 26 is open. If the car 12 stops away from floor level, or is otherwise stopped with the electromechanical lock 39 deenergized to lock the door 26, authorized personnel can release the hatch door closest to the car with a special key, and apply a lateral pulling force to cable 110. Pulling cable 110 pivots lever 102 in a counterclockwise direction, as viewed in the Figures, to the broken line position shown in FIG. 3, causing finger 100 to lift plunger 66 and allow leg portion 94 of the second bracket means 62 to pass through the space defined by the spaced leg portions 74 and 82 of the first bracket means 60.

If the car is stopped with the car door vane engaged in the hatch door drive blocks, the hatch door can be opened to the extent of dimension 96 shown in FIG. 3, which dimension is selected to be sufficient to enable authorized personnel to reach between the hatch door and jamb to release the interlock, and to then pull the release cable 110.

Figure 4:
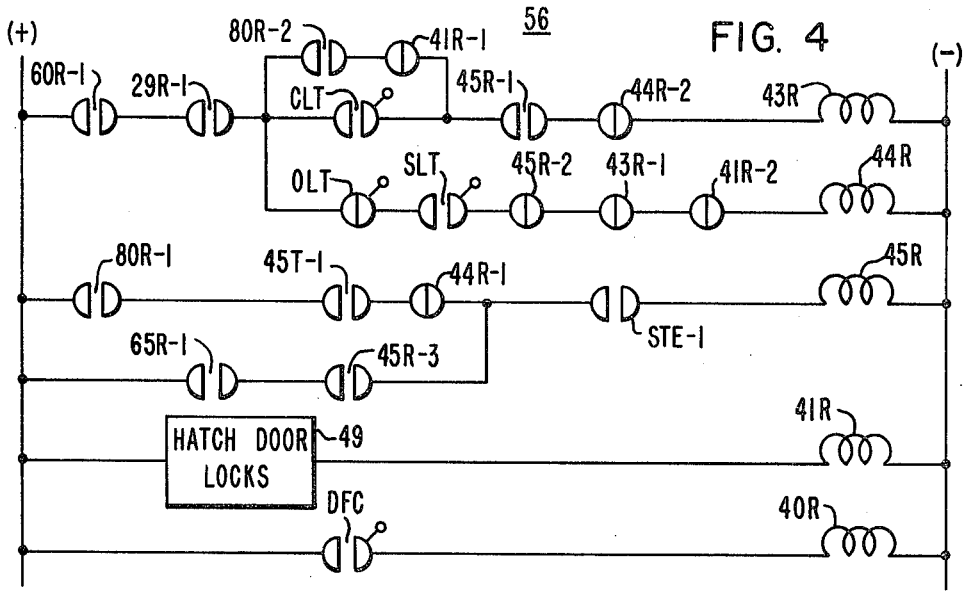
FIG. 4 is a schematic diagram of certain door control functions.
Figure 5:
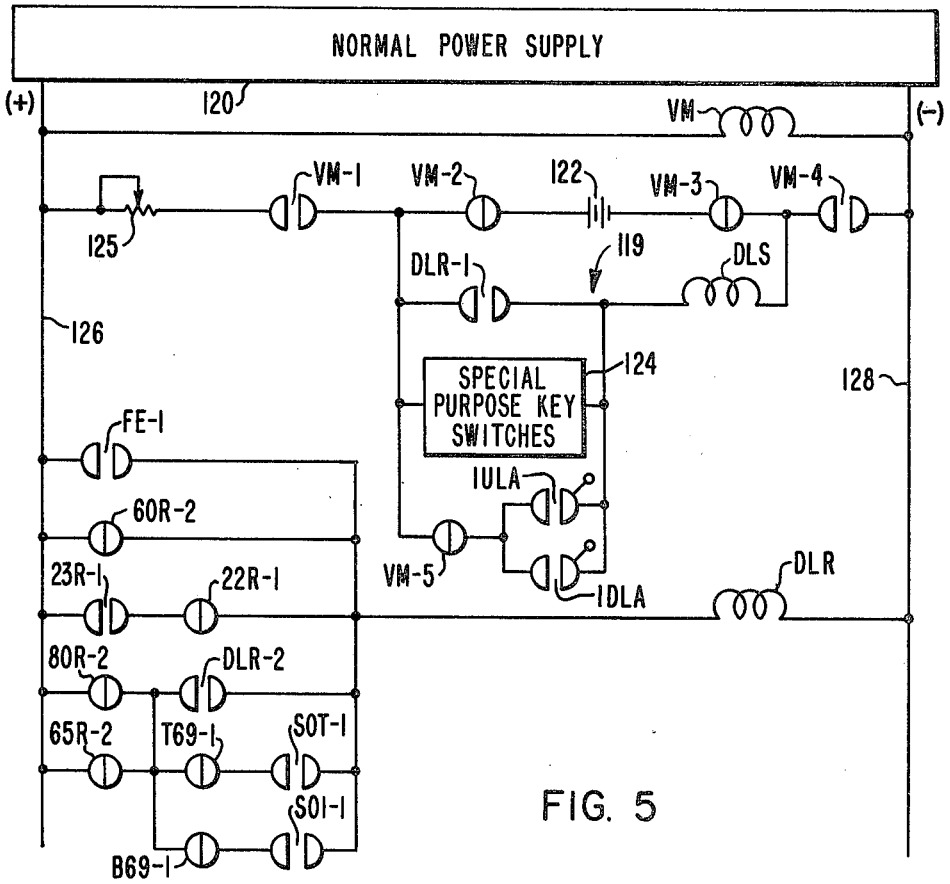
FIG. 5 is a schematic diagram of electrical controls for implementing the electromechanical door lock function utilizing conventional landing and leveling circuits to define the allowable zone adjacent to each floor, which zone identifies where the car doors may be unlocked.

FIG. 4 illustrates conventional door control relays which are part of the door control 56 shown in block form in FIG. 2. The illustrated relays, as well as those not shown but whose contacts are shown, are listed in the following table. The relays of FIG. 5 are also listed in the table.

TABLE

| Relay | Function |
|---|---|
| B69 | Bottom Floor Relay - This relay is energized |

TABLE-continued

| Relay | Function |
|---|---|
| | except when the car is at the bottom floor. |
| DLR | Door Latch Relay - When energized, it energizes the door latch solenoid DLS to unlock the car door. When deenergized, it deenergizes DLS to lock the car door. |
| DLS | Door Latch Solenoid |
| FE | Fire Emergency Relay - This Relay is energized during a fire emergency. |
| SOT | Floor Selector Relay - This relay is energized when the selector notches in to the top floor. |
| SO1 | Floor Selector Relay - This relay is energized when the selector notches in to the bottom floor. |
| STE | Safety Edge Relay - This relay drops out when the door safety edge is actuated, and also when the door open pushbutton is operated. |
| T69 | Top Floor Relay - This relay is energized except when the car is at the top floor. |
| VM | Voltage Monitor Relay - This relay drops out when the normal power supply fails. |
| 22R | Leveling Zone Relay - This relay drops out when the car is in the leveling zone of a target floor. |
| 23R | Running Relay - This relay picks up at the start of a run and drops out when the run has been completed. |
| 29R | Safety Relay - It is energized when a serial string of safety contacts are all made. |
| 40R | Car Door Relay - This relay is picked up when the car doors are closed, and dropped out when the car doors are not closed. |
| 41R | Hatch Door Relay - This relay picks up when all hatch doors are closed. |
| 43R | Door Operator Close Relay - This relay picks up to initiate door closing when 45R requests door closing, and it drops out when 45R requests door opening. |
| 44R | Door Operator Open Relay - This relay picks up to initiate door opening when 45R requests door opening, and it drops out when the doors are fully open. |
| 45R | Master Door Relay - This relay picks up to request door closing, and it drops out to request door opening. |
| 45T | Door Reopen Time Relay - This relay drops out during door reopen timing. |
| 60R | "Hand" Relay - This relay is picked up on automatic operation, and dropped out on hand operation. |
| 65R | Running Relay - This relay picks up at the start of a run, and it drops out at the end of a run. |
| 80R | Master Start Relay - This relay picks up to initiate a run. |

More specifically, when car 12 is sitting at a floor with its door open and master start relay 80R picks up to initiate a run, contact 80R-1 closes which picks up the master door relay 45R through contact 44R-1. Contact 45T-1 is controlled by door reopen time relay 45T, and will normally be closed. Contact STE-1 is controlled by relay STE, which is responsive to the door safety edge, and to the door open pushbutton in the car. It will normally be closed. When running relay 65R picks up at the start of a run, relay 45R seals in via contacts 45R-3 and 65R-1. When 45R picks up, contact 45R-1 closes to pick up the door operator close relay 43R via contacts 60R-1, which is closed on automatic operation, 29R-1, which is closed when the safety circuits are normal, 80R-2, which is now closed, 41R-1, which is closed when the hatch door is open, and 44R-2, which is closed because relay 44R drops out when the doors reach their fully open position. When the car door closes, car door relay 40R picks up via switch DFC. When the hatch door closes, the hatch door locks shown generally at 49, cause relay 41R to pick up, if they are all made.

At the end of a run, relay 80R drops, opening its contact 80R-1. The master door relay 45R thus drops to request door opening by opening its contact 45R-1 and closing its contact 45R-2. Door operator open relay 44R picks up to initiate door opening via contacts 60R-1, 29R-1, OLT, SLT, 45R-2, 43R-1, and 41R-2. As hereinbefore explained, limit switch SLT is actuated to its closed position when solenoid coil DLS is energized. If solenoid coil DLS is not energized, the door operator open relay 44R cannot initiate door opening via the door operator.

FIG. 5 is a schematic diagram of the control 57 for the electromechanical door lock 39, which sets forth an embodiment of the invention in which the lock control 57 uses the landing and leveling control of an elevator system to define the "locked" and "unlocked" zones.

More specifically, it will first be assumed that the normal DC power supply 120 is operative, energizing voltage monitor relay VM. Contacts VM-2 and VM-3 of relay VM are thus open, isolating a car top battery 122 from the door latch solenoid circuit 119. Battery 122 may be part of the emergency power pack for the car 12. Contact VM-5 of relay VM will also be open, disabling auxiliary leveling switches 1ULA and 1DLA. During normal power conditions, leveling switches 1UL and 1DL define the "locked" and "unlocked" zones. Contacts VM-1 and VM-4 of relay VM will be closed, enabling the door latch solenoid DLS to operate from the normal power supply 120. The normal circuit for solenoid DLS includes an adjustable resistor 125. It is adjusted until the voltage drop across solenoid DLS is the same as when the emergency power supply, i.e., battery 122, is connected to solenoid DLS. This enables a single solenoid coil to be used for both the normal and emergency power supplies. Resistor 125 is adjustable to accommodate different length traveling cables.

The door latch release relay DLR, during normal operation, is controlled by contacts 23R-1 and 22R-1 of relays 23R and 22R, respectively. These relays are shown in incorporated U.S. Pat. No. 3,902,572. Relay 23R picks up at the start of a run, and drops out when the run has been completed. Relay 22R is energized until the car 12 is in the leveling zone of a target floor, and it is deenergized as long as at least one of the leveling switches is on cam 30. Thus, when car 12 is making a run, contact 23R-1 will be closed and contact 22R-1 will be open. Relay DLR and solenoid DLS will be deenergized, and the car door will be locked in its closed position. When car 12 approaches a target floor, relay 22R will drop out as soon as switch 1UL, or switch 1DL, engages cam 30. Its contact 22R-1 thus closes to energize DLR, contact DLR-1 closes to energize solenoid DLS, and the door is unlocked. Before relay 23R drops, a seal-in circuit is made, which includes contact DLR-2, and either contact 80R-2 or contact 65R-2. Master start relay 80R drops before relay 23R drops to establish the seal. When the car direction circuits open, running relay 65R drops, as does relay 23R, with contact 65R-2 providing a seal-in path which survives the pick up of start relay 80R at the start of the next run.

At the start of the next run, relay 23R picks up before seal-in circuit is broken, to maintain DLR and DLS energized until both leveling switches 1UL and 1DL are off cam 30. When both are off cam 30, relay 22R picks up to deenergize relay DLR and solenoid DLS. This arrangement insures that the car door will be fully closed before the locking function is initiated.

During automatic operation of the elevator car 12, relay 60R will be energized, and thus its contact 60R-2 will be open. When service personnel take over the operation of car 12 and place it on "hand" control, they deenergize relay 60R, such as via a key switch. Thus, on hand control, contact 60R-2 energizes relay DLR and solenoid DLS, and service personnel can operate the car and doors without having to contend with the door lock 39.

In the event of a fire emergency, which may be initiated by authorized personnel via a key switch, a fire emergency relay FE is energized. Its contact FE-1 thus closes, energizing DLR and DLS during this operating mode. Thus, when firemen take over control of the car, they will have complete control of the car doors.

In the event of a power failure, an initializing routine functions when power returns. This routine may include running the car 12 to a terminal floor to reset the floor selector. At the end of this run, contacts 23R-1 and 22R-1 will function as hereinbefore described to unlock the car door 26 when the leveling zone of the terminal floor is reached. If the car is at a terminal floor when power returns, the selector will be reset without running the car, and thus contacts 23R-1 and 22R-1 will not unlock the car door. Thus, contacts B69-1 and SO1-1 are provided, which energize DLR and DLS when the car is at the bottom terminal floor. Switch US, shown in FIG. 1, is actuated by a cam 130 when the car is at the bottom floor. Switch US controls relay B69, deenergizing it when it is actuated by cam 130. Contact SO1-1 will be closed, as the floor selector relay SO1 will be energized when the car 12 is located at the bottom floor.

In like manner, contacts T69-1 and SOT-1 provide the same function for the upper terminal floor. Cam 130 actuates a switch similar to switch US when the car is at the top floor, deenergizing upper terminal relay T69. Floor selector relay SOT will be energized when car 12 is at the upper terminal floor. Relays B69, T69, SO1 and SOT are shown in incorporated U.S. Pat. No. 4,317,506.

During a power failure, a self contained, car mounted circuit for operating solenoid DLS is rendered operative by the dropping out of relay VM. This circuit requires no signals or electrical power from the traveling cable 32. Thus, the emergency circuit will operate during a power failure, even in the event the traveling cable 32 separates from the car 12.

More specifically, when the normal power supply 120 fails to hold relay VM in its actuated position, contacts VM-1 and VM-4 open to isolate solenoid DLS from the conductors 126 and 128 of the normal power supply 120. Contacts VM-2 and VM-3 close to connect battery 122 to the solenoid circuit 119, and contact VM-5 closes to enable the auxiliary leveling switches 1ULA and 1DLA. Thus, if one or both of the auxiliary leveling switches is actuated by a leveling cam 30, solenoid DLS will be energized and the door 26 will be unlocked.

Solenoid DLS may also be energized when the elevator car 12 is placed in a special operating mode via one of the key switches 124, such as a key switch for (a) hand or service mode, (b) fireman's service, (c) hospital emergency service, and the like.

In summary, there has been disclosed a new and improved elevator system having an electromechanical door lock, with the door lock having the flexibility necessary to enable it to: (a) accommodate automatic locking of the car door when the car is outside an allowable displacement zone from a floor, and automatic unlocking of the door when the car is in such a zone, (b) to provide ventilation of a locked car via the door when the car is stopped outside the allowable displacement zone, (c) to allow manual release of a locked car by authorized personnel from outside the car (d) to allow electrical release of a locked car by authorized personnel from outside the car, (e) to automatically lock the car door, if desired, upon power failure, regardless of the position of the car relative to a floor by simply omitting the emergency power supply feature; or, to only lock the door during power failure when the car is outside the allowable displacement zone, by providing the emergency power supply feature, (f) to define the allowable displacement zone using equipment designed to provide other elevator related functions, eliminating the need for a special hatch equipment, (g) to perform all wiring and installation of the lock hardware at the factory, and (h) to allow the electromechanical lock to function as a "door release", when desired.

We claim as our invention:

1. An elevator system, comprising:

a structure having a hatchway and a landing, an elevator car, means mounting said elevator car for movement in said hatchway from a position displaced from the landing to a predetermined position adjacent to the landing, said elevator car having an opening, closure means for controlling passenger movement between the car and landing through said opening, marker means associated with the landing indicative of an allowable displacement zone of the elevator car from the landing within which the closure means may be actuated to allow passenger exit from the car, in the event the elevator car stops for an unscheduled length of time at a position other than level with said landing, and electromechanical means responsive to said marker means, including means carried by said elevator car for detecting said marker means, and for mechanically preventing actuation of said closure means, at least to an extent which would enable passenger exit from the car, when the elevator car is outside said allowable displacement zone.

2. The elevator system of claim 1 wherein the electromechanical means includes a member operable between first and second positions with the first position contacting said closure means, at least when an attempt is made to actuate the closure means, to prevent movement thereof to a point which would enable passenger exit from the car, and with the second position being a non-contacting position.

3. The elevator system of claim 2 wherein the electromechanical means includes solenoid means, with said solenoid means controlling the operable member, and wherein energization of said solenoid means operates the member to its second position, and deenergization of said solenoid means operates the member to its first position.

4. The elevator system of claim 1 wherein the electromechanical means includes first and second means fixed for relative movement closely adjacent to one another when the closure means is operated from a passenger blocking position to a passenger unblocking position, and third means operable between first and second positions, while guided by said first means, with the first position of said third means being a blocking position which prevents the second means from passing said first means, and the second position being an unblocking position.

5. The elevator system of claim 4 wherein the first and second means are spaced to enable the closure means to be moved by a predetermined dimension small enough to prevent passenger exit, when the third means is in its blocking position.

6. The elevator system of claim 1 wherein the electromechanical means includes a solenoid having an armature which is in a first position when the solenoid is deenergized, and in a second position when it is energized, with the first position preventing passenger exit from the elevator car.

7. The elevator system of claim 6 wherein the electromechanical means includes first and second spaced members having aligned openings for guiding the armature of the solenoid, with the armature extending through both openings when the solenoid is deenergized, and through only one opening when it is energized.

8. The elevator system of claim 7 wherein the electromechanical means includes a member carried by the closure means disposed to strike the armature of the solenoid at a point between the first and second spaced members, when the solenoid is deenergized and an attempt is made to actuate the closure means in a direction which would allow passenger exit from the elevator car, and to pass freely between the first and second spaced members when the solenoid is energized.

9. The elevator system of claim 1 wherein the electromechanical means includes a solenoid having an armature which, when the solenoid is deenergized, is in the first position which inhibits operation of the closure means, and, when the solenoid is energized, is operated to a second position which enables normal operation, and including means for overriding the inhibit.

10. The elevator system of claim 9 wherein the means for overriding the inhibit includes means outside the elevator car for mechanically operating the armature from its first to its second position.

11. The elevator system of claim 10 wherein the means outside the elevator car includes a cable linked to the armature, wherein actuation of the cable operates the armature to its second position.

12. The elevator system of claim 9 wherein the means for overriding the inhibit includes switch means which, when actuated, energizes the solenoid without regard to the location of the elevator car relative to the marker means.

13. The elevator system of claim 12 wherein the switch means includes a key switch carried by the elevator car.

14. The elevator system of claim 1 wherein the electromechanical means includes a solenoid having an armature which, when the solenoid is deenergized, is in a first position which inhibits operation of the closure means, and when the solenoid is energized, is operated to a second position which enables operation of the closure means, wherein loss of electrical power results in deenergization of the solenoid.

15. The elevator system of claim 1 wherein the electromechanical means includes a solenoid having an armature, which, when the solenoid is deenergized, is in a first position which inhibits operation of the closure means, and which, when the solenoid is energized, is operated to a second position which enables operation of the closure means, and including a first power supply for the solenoid, and an emergency power supply for the solenoid in the event the first power supply should fail.

16. The elevator system of claim 15 wherein the emergency power supply is responsive to the first power supply, with the emergency power supply automatically being connected to the solenoid circuit upon failure of the first power supply.

17. The elevator system of claim 1 including leveling means, and wherein the marker means associated with the landing is associated with said leveling means.

18. The elevator system of claim 1 wherein the marker means includes a cam, and the electromechanical means responsive to the marker means includes a switch actuatable by said cam.

19. The elevator system of claim 1 including a plurality of landings, each having marker means associated therewith, and including means for causing the means carried by the elevator car to detect the marker means to detect only the marker means associated with the landing at which the elevator car is to make a stop, at least while the elevator car is moving.

20. The elevator system of claim 19 wherein the means carried by the elevator car to detect the marker means will detect the marker means associated with any floor, once the elevator car stops, notwithstanding an unscheduled stop adjacent to a non-target floor.

21. The elevator system of claim 1 wherein the electromechanical means includes a solenoid having an armature whose longitudinal axis is vertically oriented, first bracket means having at least two spaced leg portions having aligned openings for guiding and providing lateral support for the armature, and second bracket means carried by the closure means which passes through the spaced leg portions of the first bracket means when the solenoid is energized, and which is blocked from such passage when the solenoid is deenergized.

* * * * *